US010245874B2

(12) United States Patent
Menashe et al.

(10) Patent No.: US 10,245,874 B2
(45) Date of Patent: Apr. 2, 2019

(54) LAY-FLAT BOOK PRODUCTION

(71) Applicant: HP INDIGO B.V., Amstelveen (NL)

(72) Inventors: Avihay Menashe, Ness Ziona (IL); Lior Joseph, Ness Ziona (IL); Ilan Meiri, Yavne (IL); Itzik Kent, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/506,180

(22) PCT Filed: Aug. 28, 2014

(86) PCT No.: PCT/EP2014/065264

§ 371 (c)(1),
(2) Date: Feb. 23, 2017

(87) PCT Pub. No.: WO2016/029924

PCT Pub. Date: Mar. 3, 2016

(65) Prior Publication Data

US 2017/0274695 A1 Sep. 28, 2017

(51) Int. Cl.
*B42C 9/00* (2006.01)
*B42C 19/06* (2006.01)
(Continued)

(52) U.S. Cl.
CPC ..... *B42C 19/06* (2013.01); *B42C 9/00* (2013.01); *B42C 9/0081* (2013.01); *B65H 45/20* (2013.01);
(Continued)

(58) Field of Classification Search
CPC ..... B24C 9/0081; B65H 45/16; B65H 45/20; B65H 45/30
(Continued)

(56) References Cited

U.S. PATENT DOCUMENTS 1,182,296 A * 5/1916 Morden ..... B65H 45/20 270/39.05
1,747,719 A * 2/1930 Korndorfer ..... B65H 45/20 493/353
(Continued)

FOREIGN PATENT DOCUMENTS

GB 2199536 A 7/1988

OTHER PUBLICATIONS

Petratto Photo Bat, (http://www.ifsl.uk.com/product/petratto-photo-bat/), Sep. 15, 2011.

*Primary Examiner* — William R Harp
(74) *Attorney, Agent, or Firm* — HP Inc. Patent Department

(57) ABSTRACT

Provided is a lay-flat book block production apparatus. The apparatus comprises a glue dispenser, the glue dispenser to transition between an active state in which glue is to be provided to one side of the web which is to be guided past the glue dispenser and an inactive state in which glue is not to be provided to the web which is to be guided past the glue dispenser. The apparatus further comprises a folding unit, wherein the folding unit is to fold the web along a plurality of crease lines wherein each of a plurality of flat portions of a side of the folded web faces another of the plurality of flat portions of a same side.

10 Claims, 3 Drawing Sheets

(51) Int. Cl.
*B65H 45/30* (2006.01)
*B65H 45/20* (2006.01)

(52) U.S. Cl.
CPC ..... *B65H 45/30* (2013.01); *B65H 2301/5152* (2013.01)

(58) Field of Classification Search
USPC ..... 270/39.05
See application file for complete search history.

(56) References Cited

U.S. PATENT DOCUMENTS

| | | | | |
|---|---|---|---|---|
| 1,781,422 | A * | 11/1930 | Wise Wood | B65H 45/161 101/420 |
| 4,828,540 | A * | 5/1989 | Fordyce | B65H 45/20 493/414 |
| 4,828,636 | A * | 5/1989 | Rausing | B42C 9/00 156/204 |
| 5,863,372 | A | 1/1999 | Fabel | |
| 7,691,044 | B2 * | 4/2010 | Petratto | B31F 1/0025 493/397 |
| 7,874,780 | B2 | 1/2011 | Willauer | |
| 8,182,188 | B2 | 5/2012 | Manico et al. | |
| 8,668,228 | B2 | 3/2014 | Holmberg | |
| 2005/0116461 | A1 * | 6/2005 | Katz | B42C 9/00 281/21.1 |
| 2008/0143807 | A1 * | 6/2008 | Bartley | B41J 3/44 347/104 |
| 2012/0275881 | A1 | 11/2012 | Muller | |

* cited by examiner

LAY-FLAT BOOK PRODUCTION

CROSS-REFERENCE TO RELATED APPLICATION

This application is a U.S. National Stage Application of and claims priority to International Patent Application No. PCT/EP2014/065264, filed on Aug. 28, 2014, and entitled "LAY-FLAT BOOK PRODUCTION," which is hereby incorporated by reference in its entirety.

BACKGROUND

In a book produced by traditional book binding, bound sheets do not naturally lay flat. Forcing the sheets to do so may cause damage to the pages and the binding. An alternative to traditional book binding is lay-flat book binding.

BRIEF DESCRIPTION OF THE DRAWINGS

Certain examples are described in the following detailed description and in reference to the drawings, in which.

DETAILED DESCRIPTION

Figure 1:
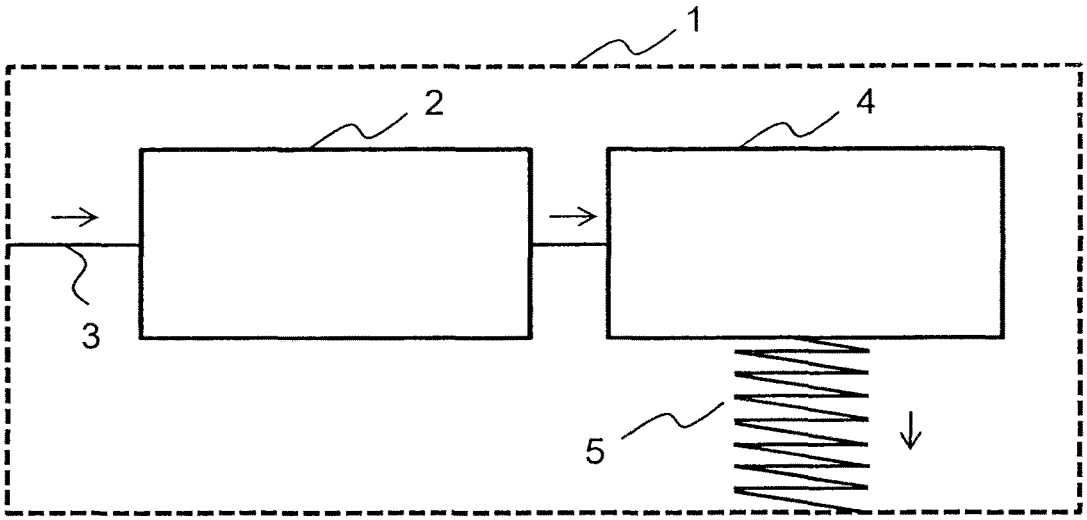
FIG. 1 is a schematic perspective view of a lay-flat book block production apparatus, according to one example.

FIG. 1 is a schematic perspective view of a lay-flat book block production apparatus 1, according to one example. The apparatus 1 comprises a glue dispenser 2. In operation, the glue dispenser 2 transitions between an active state in which glue is provided to one side of a web 3 which is guided past the glue dispenser 2 as indicated by the arrows in FIG. 1 and an inactive state in which glue is not provided to the web 3 which is guided past the glue dispenser 2. The apparatus 1 further comprises a folding unit 4. In operation, the folding unit 4 folds the web 3 along a plurality of crease lines wherein each of a plurality of flat portions of a side of the folded web faces another of the plurality of flat portions of the same side, thereby arranging the folded web 3 in the form of a pile 5 of flat web portions as shown in FIG. 1.

Figure 2:
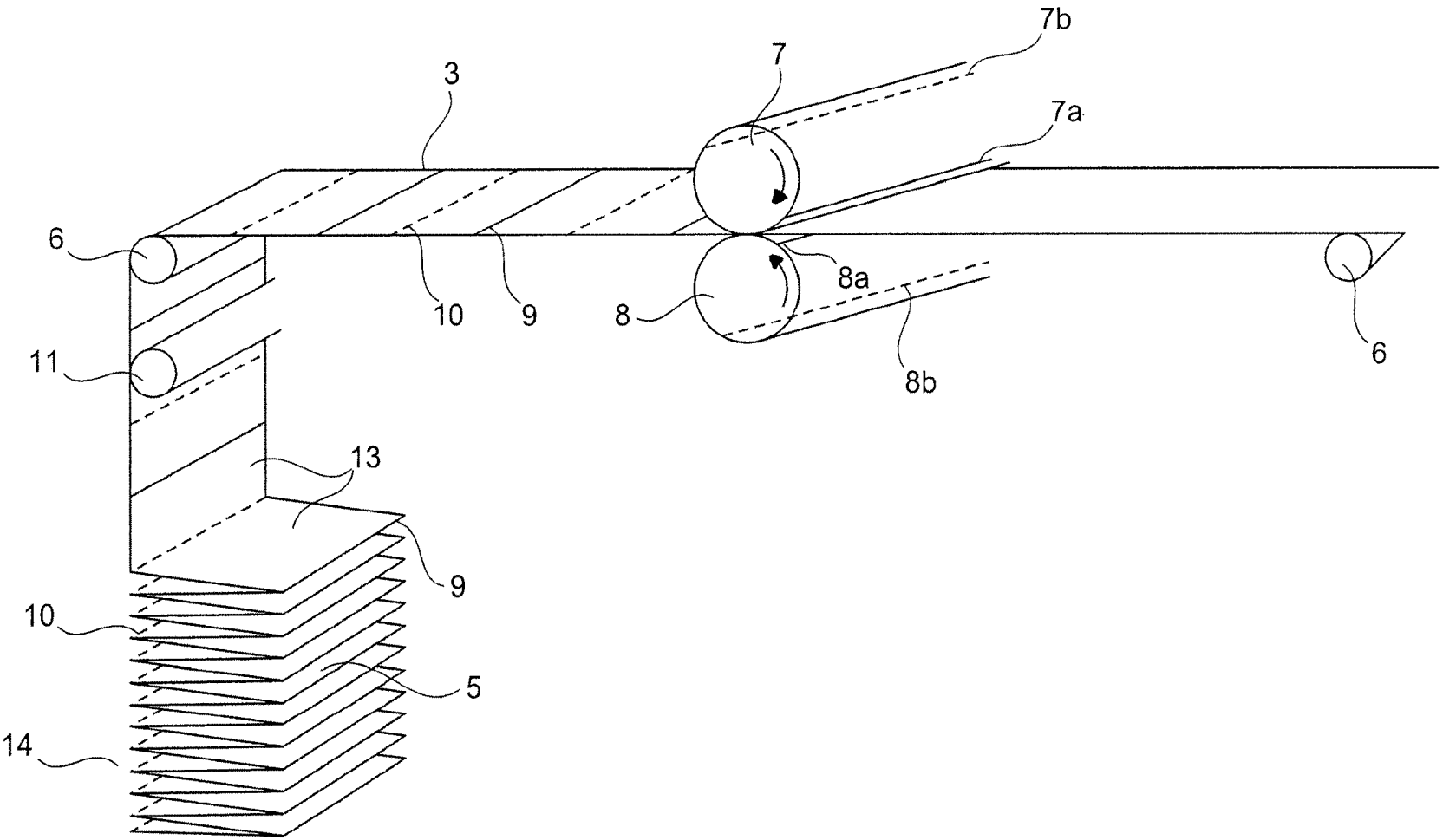
FIG. 2 is a schematic perspective view of a lay-flat book block production apparatus, according to a further example.

FIG. 2 is a schematic, perspective view of a lay-flat book block production apparatus, according to another example. The apparatus comprises a web guide which guides a web 3 along a predefined path, referred to as web guiding path in the following. The web 3 may comprise paper and may be printed on and/or laminated on one side, i.e., the upper side of the web 3 conveyed on the web guide as shown in FIG. 2. For example, the web guide may be coupled to a web guide of a printing and/or finishing apparatus that performs simplex printing and/or laminating. Alternatively, the web 3 may be printed on and/or finished by a separate printing and/or finishing apparatus and then fed to the web guide of the lay-flat book block production apparatus. As shown in FIG. 2, the web guide may comprise one or several cylindrical guiding rolls 6. Some or all of the guiding rolls 6 may be coupled to a driving means (not shown). The driving means may be a mechanical or an electrical means such as, for example, a chain drive or an electric drive. The electric drive may be controlled by a controller that controls the rotational speed of the guiding roll to which the driving means is coupled and hence, the speed at which the web 3 is conveyed along the web guiding path.

The web guide shown in FIG. 2 is of illustrative nature only and may comprise further features for guiding the web 3 along the web guiding path such as further rollers and other elements. Accordingly, the term "web guide" as used throughout description and claims is to be understood to encompass any web guide or web conveyor that is suitable for guiding or conveying a web along a web guiding path.

While being conveyed along the web guiding path, the web 3 is processed by a folding unit. The term "folding unit" as used throughout the description and claims is to be understood in a broad sense to be any assembly that comprises elements that assist in producing a folded web 3. In particular, the folding unit may consist of elements that are arranged along the web guiding path such as crease rollers or perforation rollers as will be explained in greater detail below.

In the example shown in FIG. 2, the folding unit comprises a first roller 7. The first roller 7 has a cylindrical or substantially cylindrical shape. The longitudinal axis of the first roller 7 is perpendicular to a conveying direction of the web 3. As indicated by the arrow in FIG. 2, the first roller 7 rotates clockwise, as the web 3 is guided past the first roller 7 to the left.

The first roller 7 may be provided with a protruding portion 7*a*. The protruding portion 7*a* protrudes radially outwards from the surface of the cylindrically-shaped first roller 7. In addition, the protruding portion 7*a* extends in the longitudinal direction, i.e. parallel to the longitudinal axis of the cylinder that forms the basis of the first roller 7.

When the web 3 passes the first roller 7, the protruding portion 7*a* may crease the web 3 at every revolution of the first roller 7, thereby providing crease lines 9 to the web 3. The distance between consecutive crease lines 9 can be adjusted by controlling the speed of the web 3 relative to the speed of rotation of the first roller 7. For example, when the speed of the web 3 is held constant, increasing the speed of the first roller 7 will decrease the distance between consecutive crease lines 9. Analogously, decreasing the speed of the first roller 7 will increase the distance between consecutive crease lines 9. Without controlling the speed of the first roller 7 or the speed of the web 3, the distance between consecutive crease lines 9 can be adjusted by replacing the first roller 7 with another roller which has a greater or smaller circumference. In some examples, the distance between consecutive crease lines 9 of the web 3 can be reduced by a replacement roller which has the same size as the first roller 7 but comprises further protruding portions.

Accordingly, by controlling the speed of the first roller 7, the speed of the web 3 and/or by providing a roller that is different to the first roller 7 in respect to size and/or number of protruding portions, the distance between consecutive crease lines 9 of the web 3 can be set and, as will be become more apparent from the following description, a size of sheets of lay-flat book blocks can be adjusted as desired.

Typically, the first roller 7 will have one protruding portion 7*a* or multiple protruding portions which are equally spaced around the circumference of the first roller 7, i.e. protruding portions that divide the cylinder surface of the first roller 7 into areas that are equal in size. In a particular example, however, a roller may be used that does not have protruding portions that are equally spaced around the circumference of the roller. Such a roller may be used for producing book blocks with pages of different sizes. For example, book blocks may be produced where each page is larger in size than a preceding page. In a book block produced in said manner, page numbers or other content placed at a periphery of each page may be visible even when the page is not open. Hence, content of a page that is intended to catch a user's attraction may be placed at an outer edge of a page thereby inciting the user to open the page thus avoiding that the page is disregarded. In essence, book blocks with pages of different sizes give further options for book designers.

As shown in FIG. 2, the folding unit may further comprise a second roller 8 which is arranged along the web guiding path with the web 3 passing between the first roller 7 and the second roller 8. The second roller 8 may have a cylindrical or substantially cylindrical shape. As shown in FIG. 2, a longitudinal axis of the second roller 8 may be perpendicular to a conveying direction of the web 3 and the first and second roller 7, 8 may be symmetrically arranged at opposing sides of the web 3. As indicated by the arrow in FIG. 2, the second roller 8 rotates counterclockwise, as the web 3 is guided past the second roller 8 to the left so that the first and second rollers 7, 8 rotate in opposite directions.

The second roller 8 is provided with a notch 8*a*. The notch 8*a* is formed in the surface of the cylindrically-shaped second roller 8 and extends in the longitudinal direction, i.e. parallel to the longitudinal axis of the cylinder that forms the second roller 8. The notch 8*a* corresponds to the at least one longitudinally extending, radially protruding portion 7*a*. That means that the protruding portion 7*a* dives into the notch 8*a* when the first and second rollers 7, 8 are positioned accordingly. As a result, the web 3 that is forced by the notch 8*a* to sharply bend around the protruding portion 7*a* is creased.

In certain examples, the second roller 8 having the notch 8*a* may be replaced by a counter piece. For example, the counter piece may comprise a flat element having the notch 8*a* and being moved along a path that is in part parallel to the web guiding path. Furthermore, also the first roller 7 may be replaced by a creasing piece comprising a flat element having the protruding portion 7*a*, wherein the flat element is moved along a path that is in part parallel to the web guiding path. In this case, the flat pieces may be arranged and moved symmetrically on two sides of the web 3.

In some examples, the first roller 7 may be replaced by the creasing piece. In this case, the protruding portion 7*a* would dive into the notch 8*a* in the second roller 8.

In essence, any combination of rollers and/or counter and creasing piece may be used as long as the selected combination is suitably for providing for crease lines in the web 3.

As stated above, the second roller 8 matches with the first roller 7. However, this does not mean that the first roller 7 and the second roller 8 have to be equal in size, i.e. equal in diameter. Rather, the rollers are dimensioned and shaped such that, when the first and second rollers 7, 8 rotate at corresponding speeds, each protruding portion 7*a* dives into a corresponding notch 8*a*. For example, if one of the first or second rollers 7, 8 is double in circumference compared to the other of the rollers 7, 8, and if the roller of smaller diameter has one protruding portion or notch, the roller having the greater circumference may exhibit two protruding portions or two notches, respectively.

As indicated by the dotted line in FIG. 2, the second roller 8 may be provided with a line of pins 8*b*. Each pin may protrude radially outwards from the surface of the cylindrically-shaped second roller 8. In addition, the line of pins 8*b* may extend in longitudinal direction, i.e. parallel to the notch 8*a*. In some examples, the line of pins 8*b* may be arranged on a further roller that is different from the second roller 8.

When the web 3 passes the second roller 8, the pins 8*b* perforate the web 3 at each revolution of the second roller 8 and thus provide the web 3 with perforation lines. The distance between consecutive perforation lines 10 can be adjusted by controlling the speed of the web 3 relative to the speed of rotation of the second roller 8. Assuming the speed of the web 3 is constant, increasing the speed of the second roller 8 will decrease the distance between consecutive perforation lines 10. Analogously, decreasing the speed of the second roller 8 will increase the distance between consecutive perforation lines 10. Without controlling the speed of the second roller 8 or the speed of the web 3, the distance of consecutive perforation lines 10 can be adjusted by replacing the second roller 8 with another roller which has a greater or smaller circumference. In some examples, the distance between the perforation lines 10 can be reduced by adding further lines of pins to the second roller 8. Accordingly, by controlling the speed of the web 3, the speed of the second roller 8 and/or by replacing the second roller 8 with said another roller, the distance between consecutive perforation lines 10 on the web 3 can be set and, as will be become more apparent from the following description, a size of sheets of lay-flat book blocks can be adjusted.

As indicated by the dotted line in FIG. 2, the first roller 7 may be provided with a line of recesses 7*b*, each recess being formed in the surface of the cylindrically-shaped first roller 7. In addition, the line of recesses 7*b* may extend in the longitudinal direction, i.e. parallel to the protruding portion 7*a*. In some examples, when the line of pins 8*b* is arranged on a further roller that is different from the second roller 8, the line of recesses 7*b* may also be arranged on a further roller that is arranged opposite to the further roller on which the line of pins 8*b* is arranged. When such further rollers, carrying at least one line of pins and at least one line of recesses, are part of the folding unit, the above-said in view of the first and second roller 7, 8 applies analogously. Furthermore, the line of pins 8*b* and the line of recesses 7*b* may also be arranged on a further perforation piece and a further counter piece which are configured analogously to the crease and counter pieces as described above in regard to the protruding portion 7*a* and the notch 8*a*.

The longitudinally extending line of recesses 7*b* corresponds to the at least one longitudinally extending line of radially protruding pins 8*b*. That means that the pins 8*b* dive into the recesses 7*b* when the first and second rollers 7, 8 are positioned accordingly. As a result, the web 3 is perforated or punctured by the pins 8*b*.

The second roller 8 matches with the first roller 7. However, as stated above, this does not mean that the first roller 7 and the second roller 8 have to be equal in size, i.e., equal in diameter. Rather, the rollers are dimensioned such that, when the two rollers 7, 8 rotate at corresponding speeds, each pin 8*b* dives into a corresponding recess 7*b*. For example, if one of the first or second rollers 7, 8 is double in circumference compared to the other of the rollers 7, 8, the roller with the greater circumference will have two lines of pins or two lines of recesses, respectively. If, as stated above, the first and/or second roller 7, 6 are replaced by crease piece and/or counter piece, the pins 8*b* and recesses 7*b* may be arranged thereon.

After crease and perforation lines 9, 10 have been provided to the web 3, the web 3 is guided past a glue dispenser. As shown in FIG. 2, the glue dispenser may comprise a glue roller 11. Furthermore, the glue dispenser may comprise a glue reservoir (not shown). Although no particular technique for feeding glue from the glue reservoir to the glue roller 11 and spreading the glue over the surface of the glue roller 11 is shown in FIG. 2, several techniques may be applied according to circumstances. For example, the glue roller 11 may comprise cells and the glue dispenser may comprise a doctoring chamber, wherein the cells are filled with glue when the surface of the glue roller 11 dives into the glue provided in the doctoring chamber and a doctor blade doctors excess glue from the glue roller 11. In some examples, glue may be spread over the glue roller 11 by a coating tool such as a coating die. The reservoir for providing the glue to the doctoring chamber or the coating tool may be a tank which is connected to the doctoring chamber or the coating tool by at least one tube wherein glue is conveyed by a pump.

The glue dispenser may transition from an active to a passive state and vice versa. In the active state, the glue dispenser dispenses glue to a side of the web 3 that faces the glue roller 11 and comes into contact with the glue roller 11 when being guided past the glue dispenser.

In particular, the glue dispenser may operate in the active state while a portion of the web 3 that is intended to form part of a first book block is guided past the glue dispenser. Furthermore, the glue dispenser may operate in the passive state while a portion of the web 3 is guided past the glue dispenser that comprises a portion of the first book block and a portion of a second book block. Hence, the size of the first book block may be defined by the glue dispenser transitioning from the active state to the passive state.

A transition of the glue dispenser from the active to the passive state may comprise moving the glue roller 11 from a first position in which the glue roller 11 contacts the web 3 to a second position in which the glue roller 11 does not contact the web 3. In some examples, the guiding path of the web 3 may be changed. For example, the glue dispenser may comprise a means for pulling the web 3 away from the glue roller 11. In particular, the glue dispenser may comprise a means for providing for a negative pressure along a portion of the web guiding path on the side of the web 3 that is opposite to the side that comes into contact with the glue roller 11 so that the web 3 is pulled by the negative pressure from the glue roller 11. The means may comprise a low friction surface along which the web 3 is guided, i.e. slides when the negative pressure is applied to the web 3. As a further alternative, a further guiding roll 11 may be provided upstream, i.e. against the conveying direction of the web 3, and temporarily change the web guiding path by contacting the glue roller side of the web 3 so that the web 3 is pulled from the glue roller 11.

After glue has been applied to the web 3, the web 3 may be folded by elements of the folding unit along the crease lines 9 and the perforation lines 10 as shown in FIG. 2, thereby arranging the folded web 3 as a pile 5 of flat web portions 13 where the crease lines 9 are at one side of the pile 5 and the perforation lines 10 are at an opposite side 14 of the pile 5. In case that no perforation lines 10 are provided, the folding unit folds the web 3 along the crease lines 9 as shown in FIG. 2 and provides for further creases at the side 14 of the pile 5 that is opposite to the crease lines 9.

As shown in FIG. 2, the web 3 is folded such that flat portions 13 of the same side face each other. As portions of the side of the web 3 that faces the glue roller 11 when being guided past the glue dispenser are provided with glue, the respective folded flat portions 13 that face each other when being arranged in the pile 5 adhere to each other. In the particular example shown in FIG. 2, the pile 5 of flat web portions 13 would, once separated from the unfolded web 3, correspond to a lay-flat book block whose binding side is to the right.

To enable separation of separate book blocks, glue is not applied to at least two flat portions 13 which face each other as described above in regard to the glue dispenser. Then, portions of the side 14 of the pile 5 which is opposite to the one side of the pile 5 at which the crease lines 9 are arranged are cut away thereby separating the glued book blocks.

Figure 3:
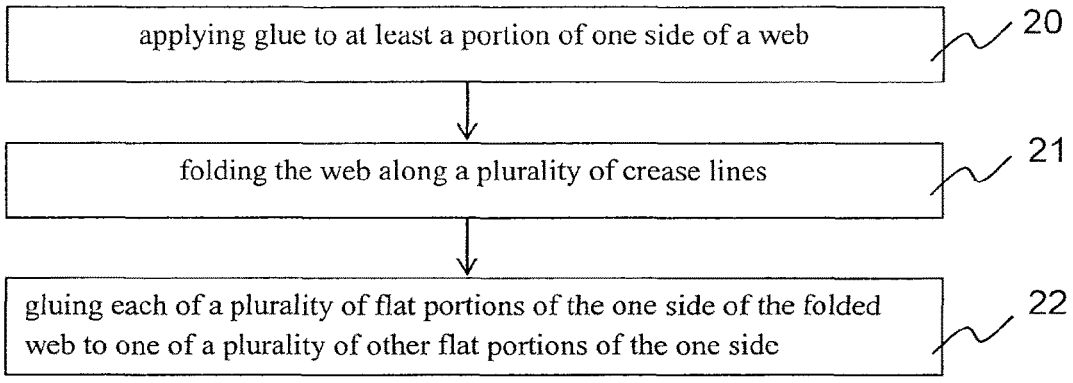
FIGS. 3 to 5 are flow charts illustrating a procedure for producing lay-flat book blocks, according to some examples.
Figure 4:
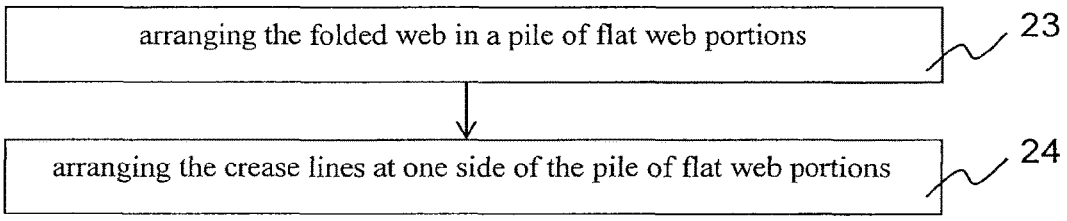
Figure 5:
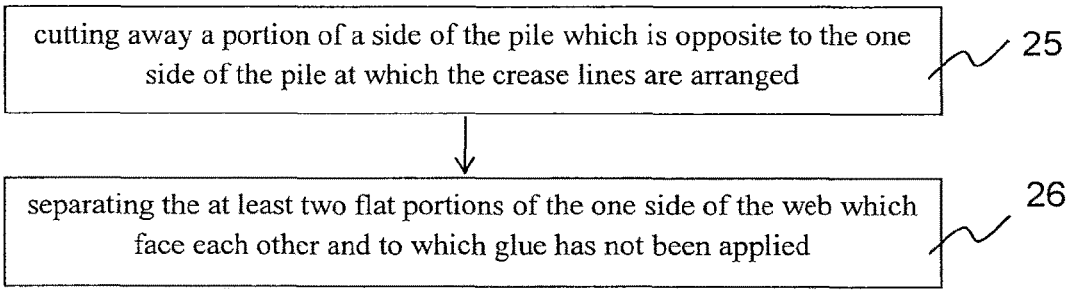

FIGS. 3, 4, and 5 are flow charts illustrating a procedure for producing lay-flat book blocks, for example by an apparatus as described above with reference to FIG. 1 or 2.

As shown in FIG. 3, the procedure starts with applying 20 glue to at least one portion of one side of the web 3. As described above, applying 20 glue may be performed by the glue dispenser which is arranged along the web guiding path. After glue has been applied to the web 3, the procedure continues by folding 21 the web 3 along a plurality of crease lines 9. As described above, said step may be carried out by the folding unit 4. The procedure continues with gluing 22 each of a plurality of flat portions 13 of the one side of the folded web 3 to one of a plurality of other flat portions 13 of the one side. As described above, gluing 22 may be carried out by the folding unit 4 which piles the flat portions 13 of the web 3 to which glue has been applied.

The procedure may comprise not applying glue to at least two flat portions 13 of the one side of the web 3 which face each other. As described above, said step is carried out by the glue dispenser 2 which transitions from the active state to the passive state, so that portions of the web 3 that are conveyed past the glue dispenser 2 are not provided with glue.

The folding may further comprise the steps shown in FIG. 4. In particular, the folding 21 may comprise arranging 23 the folded web 3 in a pile 5 of flat web portions 13. Said step may be followed by arranging 24 the crease lines 9 at one side of the pile 5 of flat web portions 13.

Furthermore, after the web 3 has been folded, the procedure may be continued by the steps shown in FIG. 5. In particular, the procedure may further comprise cutting 25 away a portion of a side 14 of the pile 5 which is opposite to the one side of the pile 5 at which the crease lines 9 are arranged. The cutting may be followed by separating 26 the at least two flat portions 13 of the one side of the web 3 which face each other and to which glue has not been applied.

A book block produced in accordance with the method and apparatus described herein may, in some examples, naturally lay flat when the book block is opened without damage to the pages and the binding.

The invention claimed is:

1. A lay-flat book block production apparatus comprising:

a glue dispenser to transition between an active state in which glue is provided to one side of a web that is guided past the glue dispenser, and an inactive state in which glue is not provided to the web that is guided past the glue dispenser; and a folding unit to fold the web, wherein each of a plurality of flat portions of a side of the folded web faces another of the plurality of flat portions of a same side, and wherein the folding unit includes a roller pair to guide the web and provide the web with a plurality of crease lines and a plurality of perforation lines, wherein:

a first roller of the roller pair includes at least one longitudinally extending, radially protruding portion to dive into at least one corresponding longitudinally extending notch of a second roller of the roller pair to crease the web, wherein the at least one corresponding longitudinally extending notch forces the web to sharply bend around the at least one longitudinally extending, radially protruding portion, and the second roller of the roller pair includes at least one longitudinally extending line of radially protruding pins to dive into at least one longitudinally extending line of recesses of the first roller of the roller pair to perforate the web.

2. The lay-flat book block production apparatus according to claim 1, wherein the folding unit is to fold the web along the plurality of perforation lines.

3. The lay-flat book block production apparatus according to claim 1, wherein the folding unit arranges the folded web in a pile of flat web portions.

4. The lay-flat book block production apparatus according to claim 3, wherein the folding unit further arranges the plurality of crease lines at one side of the pile of flat web portions.

5. A method of producing lay-flat book blocks, comprising:

guiding a web along a roller pair of a folding unit;

providing the web with a plurality of crease lines and a plurality of perforation lines, including:

creasing the web by diving at least one longitudinally extending, radially protruding portion of a first roller of the roller pair into at least one corresponding longitudinally extending notch of a second roller of the roller pair; and perforating the web by diving at least one longitudinally extending line of radially protruding pins of the second roller of the roller pair into at least one longitudinally extending line of recesses of the first roller of the roller pair;

applying glue to at least a portion of one side of a web, including transitioning between an active state in which glue is provided to one side of the web that is guided past a glue dispenser, and an inactive state in which glue is not provided to the one side of the web that is guided past the glue dispenser;

folding the web along a plurality of crease lines and the plurality of perforation lines using the folding unit; and gluing each of a plurality of flat portions of the one side of the folded web to one of a plurality of other flat portions of the one side.

6. The method according to claim 5, wherein glue is not provided to at least two flat portions of the one side of the folded web that face each other.

7. The method according to claim 6, further comprising separating the at least two flat portions of the one side of the web that face each other and to which glue has not been applied.

8. The method according to claim 5, wherein the folding comprises arranging the folded web in a pile of flat web portions.

9. The method according to claim 8, wherein folding comprises arranging the plurality of crease lines at one side of the pile of flat web portions.

10. The method according to claim 9, further comprising cutting away a portion of a side of the pile that is opposite to the one side of the pile at which the crease lines are arranged.

* * * * *